US008157007B2

(12) United States Patent
Nicolas et al.

(10) Patent No.: US 8,157,007 B2
(45) Date of Patent: Apr. 17, 2012

(54) METHOD FOR CASING USING MULTIPLE EXPANDED AREAS AND USING AT LEAST ONE INFLATABLE BLADDER

(75) Inventors: Frédéric Nicolas, Rennes (FR); Yoann Riou, Laille (FR); Benjamin Saltel, Cintre (FR); Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 182 days.

(21) Appl. No.: 12/596,700

(22) PCT Filed: Apr. 16, 2008

(86) PCT No.: PCT/EP2008/054593

§ 371 (c)(1),
(2), (4) Date: Oct. 20, 2009

(87) PCT Pub. No.: WO2008/135356

PCT Pub. Date: Nov. 13, 2008

(65) Prior Publication Data

US 2010/0132952 A1 Jun. 3, 2010

(30) Foreign Application Priority Data

Apr. 20, 2007 (FR) ..... 07 02876
Jun. 5, 2007 (FR) ..... 07 03992

(51) Int. Cl.
*E21B 43/10* (2006.01)

(52) U.S. Cl. ..... 166/207; 166/313; 166/382; 166/187

(58) Field of Classification Search ..... 166/380, 166/313, 207, 50, 191, 382
See application file for complete search history.

(56) References Cited

U.S. PATENT DOCUMENTS 5,348,095 A * 9/1994 Worrall et al. ..... 166/380
5,368,809 A * 11/1994 Steketee, Jr. ..... 264/516
6,742,591 B2 * 6/2004 Metcalfe ..... 166/285

(Continued)

FOREIGN PATENT DOCUMENTS

EP 1719873 A1 11/2006
GB 2382828 A 6/2003
WO 97/06346 A1 2/1997
WO 2004/097170 A1 11/2004

OTHER PUBLICATIONS

International Search Report, PCT/EP2008/054593, dated Jul. 25, 2008.

(Continued)

*Primary Examiner* — Giovanna Wright
(74) *Attorney, Agent, or Firm* — Lerner, David, Littenberg, Krumholz & Mentlik, LLP

(57) ABSTRACT

The method of the invention comprises inserting into the well or the piping to be cased, a tube (1) including tube sections previously connected end to end, proceeding with the radial expansion of the tube using an inflatable bladder (3) so that the wall thereof bears against that (C) of the well or the piping; wherein the method is characterized in that the expansion is achieved not on the entire length of the tube but only at certain areas (4) thereof which are spaced from each other by non-expanded portions (5), so that the total length of the expanded areas (4) is substantially smaller than the total length of the non-expanded areas (5), the number of expanded areas (4) being at least equal to three. The invention can be used in the field of water or crude oil production.

27 Claims, 7 Drawing Sheets

U.S. PATENT DOCUMENTS

| | | | | |
|---|---|---|---|---|
| 2002/0020524 | A1 | 2/2002 | Gano | |
| 2004/0074640 | A1* | 4/2004 | Anderton et al. | 166/277 |
| 2005/0121203 | A1* | 6/2005 | Richard et al. | 166/380 |
| 2005/0133225 | A1 | 6/2005 | Oosterling | |
| 2006/0065408 | A1 | 3/2006 | Green et al. | |
| 2007/0272418 | A1* | 11/2007 | Corre et al. | 166/380 |
| 2010/0193124 | A1 | 8/2010 | Nicolas et al. | |

OTHER PUBLICATIONS

Inflatable Packers International Pty Ltd., Slim-line Re-lining, (Jun. 20, 2000).

International Search Report, PCT/EP2008/058873, dated Mar. 27, 2008.

* cited by examiner

METHOD FOR CASING USING MULTIPLE EXPANDED AREAS AND USING AT LEAST ONE INFLATABLE BLADDER

CROSS REFERENCE TO RELATED APPLICATIONS

The present application is a national phase entry under 35 U.S.C. §371 of International Application No. PCT/EP2008/054593, filed 16 Apr. 2008, published in French, which claims the benefit of French Patent Application No. 07/02876, filed 20 Apr. 2007 and French Patent Application 07/03992, filed 5 Jun. 2007. The disclosures of said applications are incorporated by reference herein.

The present invention relates to a lining method with multiple expanded areas for lining a well or a duct, for example a casing, having a portion to be treated in order to seal it off, notably to be repaired and/or to be plugged.

It also relates to a method for controlling the production of fluid inside a well, by lining the latter.

The invention more particularly but not mandatorily, applies to the field of water production or oil production.

In the following of the present description, the invention will be applied as an example in the field of water production.

Bore holes for collecting water are drilled into the ground and generally include a continuous liner or casing, made by a succession of steel tubes of relatively small length (of the order of 6 m to 12 m for example) welded or screwed together end-to-end.

With this casing, once it is cemented against the natural wall of the well, it is possible to obtain a seal over the whole length of the well, in order to avoid any contamination between the various soil layers.

As an indication, the total length of the casing is for example comprised between 20 meters and 1,500 meters, while its inner diameter is comprised between 75 and 250 millimeters.

Over time, it happens that a portion or the totality of the casing wall has to be sealed, notably when it has been degraded, for example by untimely wear and/or corrosion, or when the perforations intended for letting through water have to be plugged, in particular because they produce undesirable fluids which risk crossing the wall of the casing and penetrating inside the latter.

In order to repair the wall of the casing, it is known how to line the existing wall by placing a lining with a smaller diameter than the existing casing and to cement by injection the annular space formed by the old casing and the new tube. This method has the drawback of strongly reducing the diameter of the bore hole since the annular space required for proper cementation is relatively large, generally more than 30 mm on the diameter. Further, it is difficult to ensure proper coaxiality of both tubes in particular in the curved portions of the well, which may cause poor cementation, and cause contamination between the different layers of the soil.

Other methods consist of positioning in the existent casing a lining with a slightly smaller diameter and of means of proceeding with radial expansion of the new liner so that it will be flattened against the wall to be treated.

This expansion may be carried out by means of an expansion tool including a mandrel, rollers or an inflatable bladder, or even by means of an explosion.

The invention relates to an expansion method by hydroforming, using an inflatable bladder, the radial expansion of which is achieved by introducing pressurized fluid into the bladder.

The state of the art on this subject may be illustrated by the technical document offered in English and dated Jun. 30, 2000, from the Australian corporation IPI (Inflatable Packers International Pty Ltd) entitled "Slim-line Re-lining", as well as by document EP A 1 657 365.

According to these techniques, a tube of great length, formed with tube sections attached end-to-end beforehand, is introduced into the well or duct to be lined, after which it is proceeded with radial expansion of the tube over the whole of its length, so that its wall will bear against that of the well or of the duct; this expansion is achieved by a succession of successive positionings of the inflatable bladder along the tube with, in each position, a crimping operation by inflating the bladder and then deflating the latter in order to bring it to a position adjacent to the previous one, and so forth all along the tube.

Such a method is very expensive when the question is of expanding great lengths because its application requires a lot of time.

Further, significant wear of the crimping tool occurs, so that it is necessary to periodically change this tool, since its lifetime is relatively limited, because of the strong mechanical stresses to which it is subject at each step.

As an indication, the maximum number of expansion operations of such a tool, with an inflatable bladder, is generally about fifty.

Under these conditions, as an example, if a length of a 1,000 m has to be lined with a step of 0.5 m, it has to be successively proceeded with 2,000 inflation/deflation operations, which requires the use of about forty different tools.

The invention aims at overcoming these difficulties by proposing a method with which a large area of the casing may be lined rapidly and economically.

The invention may apply not only to a casing as described above, but also to any well dug in the ground or to any duct, either buried or not, and this is why in the description and the claims which will follow, the lining of a well or of a duct is reported, the latter may be a well casing or an open well, or any other vertical, horizontal or oblique, rectilinear or curved conduit.

The object of the invention is therefore a method for lining a well or a duct, for example a well casing, by means of an inflatable bladder, the totality or only certain portions of the well or of the duct having to be treated, notably repaired, and/or plugged.

As this is known, a cylindrical tube of great length, formed of tube sections attached end-to-end beforehand, for example by welding or screwing, is introduced into the well or into the duct to be lined, after which it is proceeded with radial expansion of the tube by means of an inflatable bladder, so that its wall will bear against that of the well or duct.

According to the invention, it is proceeded with this expansion, not over the whole length of the tube, but only in certain areas of the latter, which are spaced apart from each other by non-expanded portions, this in such a way that the total length of the expanded areas is notably less than the total length of the non-expanded areas, the number of expanded areas being further at least equal to three.

It is understood that by means of this technique, the time required for lining is considerably reduced relatively to known techniques, since only a portion of reduced length of the tube is treated.

Further, the number of application steps which correspond every time to inflating and deflating the bladder, involving wear of the latter, is also reduced; a single tool or a limited number of tools may therefore be used.

Of course, the technique of the invention has the drawback that the minimum inner diameter of the finally obtained liner is smaller than what would have been obtained by proceeding with its complete radial expansion.

It is nevertheless superior to that obtained by traditional cementation of a cylindrical liner, because of the significant volume of the annular space which is required for proper cementation, as this was explained earlier.

All things considered, it is sufficient in most applications.

With the technique of the invention, it is further possible to obtain at the expanded areas, perfect centering of the liner relatively to the axis of the well or of the duct, even if its wall is not of a strictly cylindrical shape and/or if it has surface irregularities in this location. Proper centering is also obtained, correlatively, at the non-expanded area which connects two expanded areas.

Moreover, according to a certain number of additional non-limiting features of the invention:

- the total length of the expanded areas is at least five times smaller than the total length of the non-expanded areas; in practice, the ratio of the total length of non-expanded liner over the total length of expanded liner may be clearly larger than 5, for example comprised between 10 and 20, or even more depending on the applications and according to the configuration of the well or the duct.
- before its expansion, the tube is provided on the outside with flexible and elastic sheaths at the areas to be expanded, so that after expansion they ensure the seal between these areas and the wall of the well or the duct;
- these flexible sheaths are housed in recesses made in the wall of the tube so that they do not protrude on the outside relatively to its external surface;
- the expansion of at least one of the ends of the tube is also caused, in order to form therein a mouth which is applied against the wall of the well or the duct;
- at least one wall portion of the tube is perforated or porous, and is adapted so as to act as a strainer or filter;
- before its expansion, the tube is provided with at least one sensor which is positioned against its external surface in an area which is not intended to be expanded, between two areas intended to be expanded;
- before its expansion, the tube is provided with at least one sensor which is placed against its external surface inside a wall recess intended to be only partly expanded;
- different expansions of the tube are caused by successive steps, by displacing the inflatable bladder gradually from one end to the other end of the tube, always in the same direction;
- after having introduced the tube inside the well or the duct, liquid cement is injected between the outer surface of the tube and the wall of the well or of the duct, it is proceeded with partial expansion of the tube when the cement is still liquid or semi-liquid, and then the cement is left to set.

The object of the invention is also a method for controlling the production of fluid inside the well, allowing the plugging of a producing area during exploitation.

It is more particularly applied to wells crossing several producing areas distributed in different locations along the well, these areas—oil or gas veins for example—being capable of producing (liquid or gas) fluids, which one desires to collect.

Over time, it happens that certain areas produce undesirable fluids, which one no longer desires to collect.

It is then desirable to isolate these areas from the inside of the well.

The goal of the invention is a method with which it is possible in a simple and inexpensive way to prevent the arrival of these undesirable fluids in the well, while of course continuing to allow production coming from other areas.

According to this control method:

- in a first phase, a cylindrical tube of great length, the diameter of which is slightly less than that of the well, is axially introduced into the well, this tube being formed with portions with a wall pervious to the relevant fluid, alternating with portions with an impervious wall, after which it is proceeded with radial expansion of the tube at certain of its portions with an impervious wall, this by means of an inflatable bladder, so that their wall will bear against that of the well, this in such a way that two neighbouring expanded regions are located on either side of the area to be controlled and are connected to each other through a tube section comprising a pervious portion and an impervious part, the latter facing the area to be controlled, and extending beyond this area in the direction of the pervious portion;
- subsequently, when it is desired to prevent the production of the area to be controlled, it is proceeded with radial expansion of the tube at the impervious portion of said tube section, beyond the area to be controlled, on the side of the pervious portion.

Thus, any communication of the outer space of the tube which faces the relevant area, with the impervious portion of the tube section is thereby prevented.

The pervious areas of the tube may consist in a perforated, meshed or porous wall.

The tube for example is in metal, and its radial expansion is advantageously (but not mandatorily) made by means of an inflatable bladder with a flexible and elastic membrane, inflation being caused by introducing high pressure liquid into the bladder.

In the petroleum field, this kind of tool is usually designated by the term of "packer".

Other features and advantages of the invention will become apparent upon reading the description hereafter, made with reference to the appended drawings wherein:

FIG. 1 illustrates a bore hole for collecting water, the wall of which with a circular or approximately circular section bears reference C. This wall may either for example consist in a deteriorated duct (or well casing), for which sealing-off is desired by fitting it with lining inside.

Figure 1:
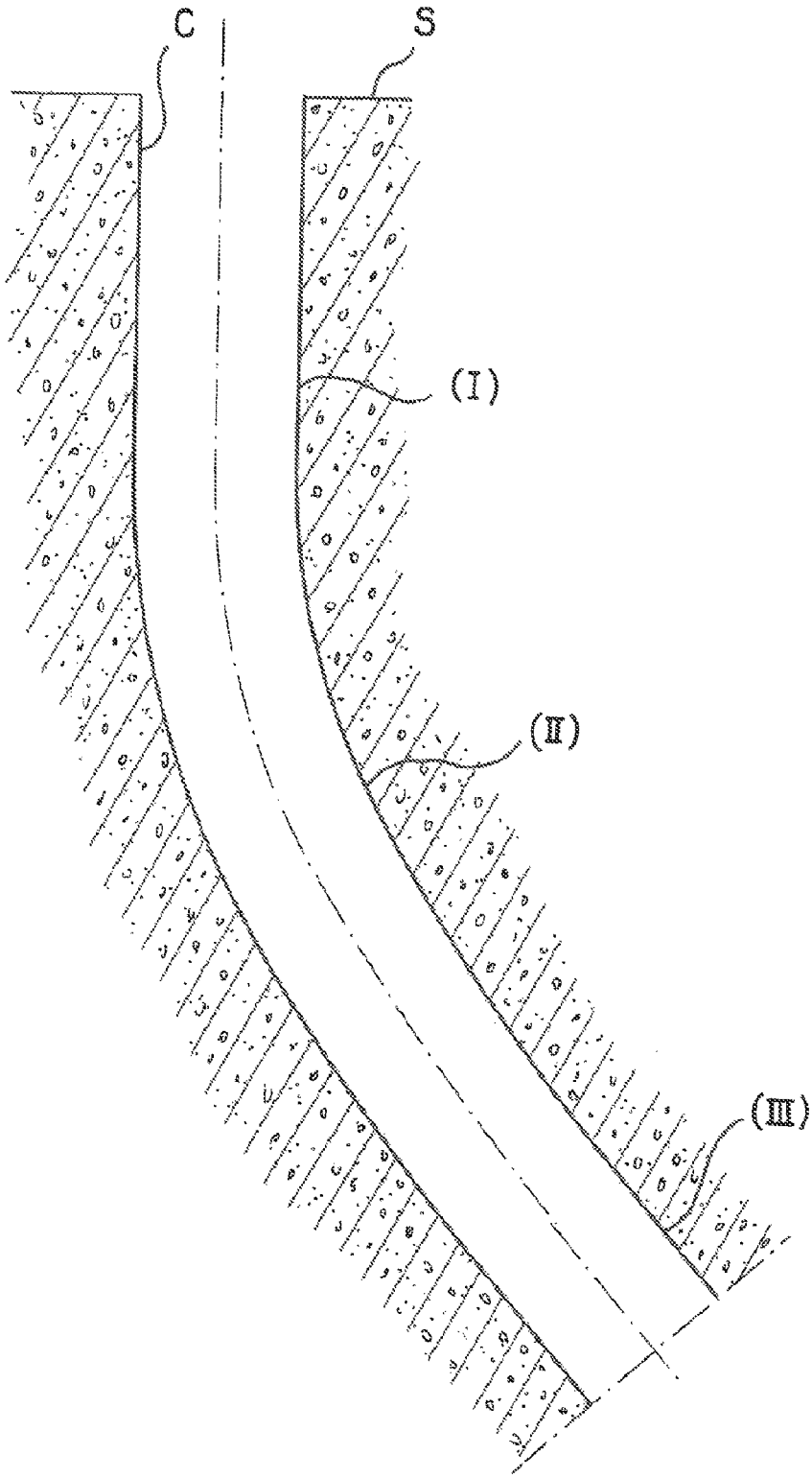
FIG. 1 is an axial sectional view of a well or a duct to be lined.

Starting from the ground level S in depth, this bore hole comprises a first rectilinear vertical upper portion (I), a curved central portion (II) and an oblique lower portion (III).

In the drawings, in order to facilitate their reading, the scale was substantially enlarged along the radial direction of the duct (perpendicularly to the axis of the bore hole) relatively to the scale used along the axial direction.

Purely as an indication, the well or the duct has a length of the order of 915 m, and a diameter of 160 mm.

In order to line the wall C of it, a metal tube for example in steel, both ductile and capable of resisting to corrosion from the medium to which it will be exposed, is used; its external diameter is selected to be slightly smaller than that of the wall C, for example equal to 145 mm, its wall thickness is for example 4 mm.

Figure 2:
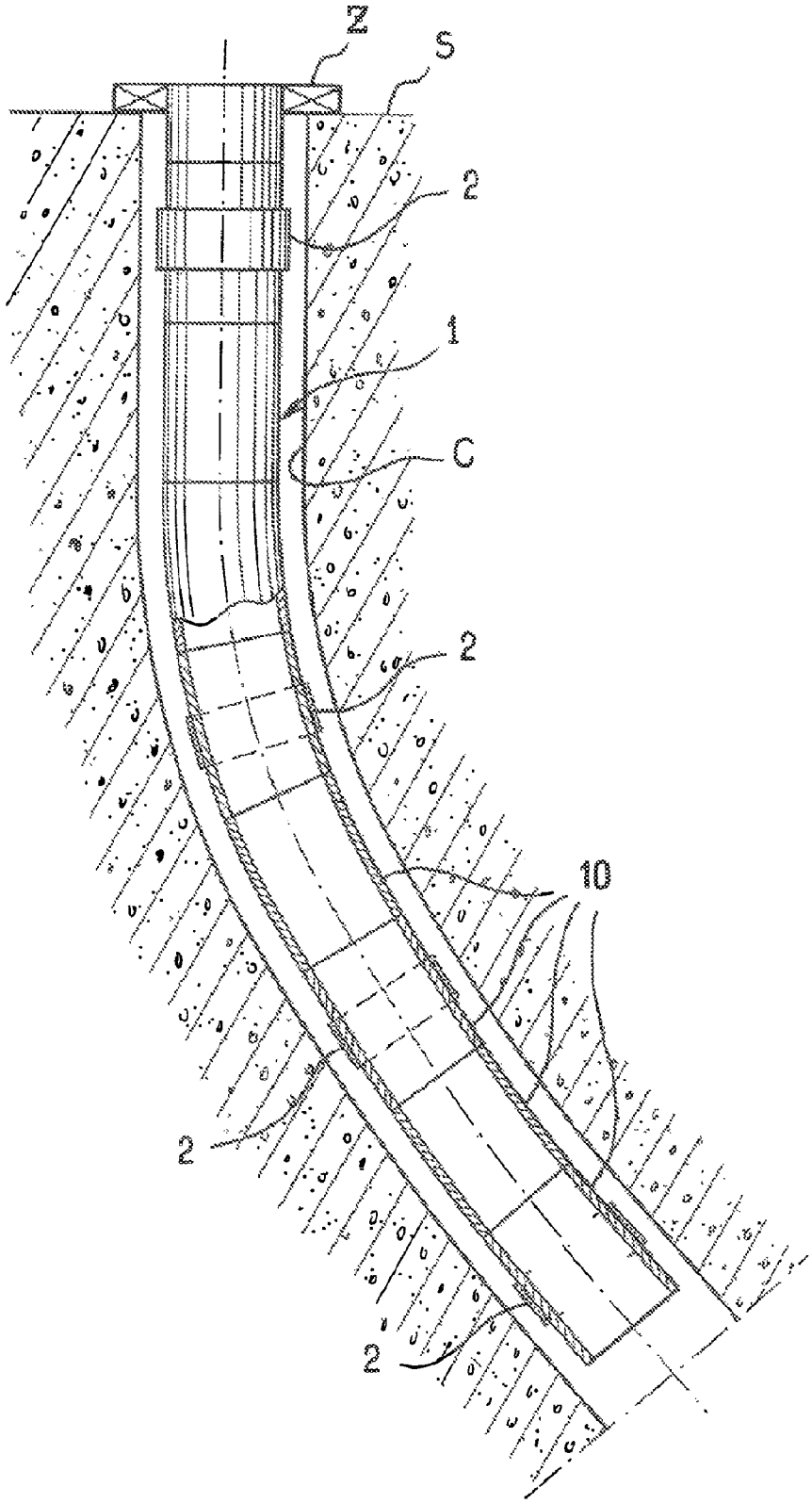
FIGS. 2-5 are schematic views illustrating different steps of the method of the invention.

This tube referenced as 1 in FIG. 2 is made from the surface S by sealably attaching end-to-end tube sections 10, which are assembled with each other, for example by welding, and then by gradually pushing in the tube as fast as it is made inside the well or the duct, according to a well-known technique (see document U.S. Pat. No. 2,167,338 for example).

As an indication, the sections 10 have a length of 12 m.

If the tube 1 has a length of 912 m, it is therefore made up from an assembly of 76 sections.

Because of the great length of the tube 1 relatively to its diameter, the tube has certain flexibility, which allows it to accommodate to the non-rectilinear configuration of the well, and to follow the curvature thereof (considerably less marked than this is suggested by FIGS. 1-5 as a result of the scale difference indicated above).

Hydroforming of this tube 1 is provided by means of a crimping tool in the form of an inflatable bladder.

Such a bladder with a flexible and elastic membrane is adapted in order to be inserted inside the tube, in the deflated condition, and to be positioned in a given area of the tube for which expansion is desired. The bladder is supplied with high pressure liquid capable of radially expanding the membrane outwards, so that the latter bears against the wall of the tube and also causes radial expansion of it outwards in order to apply it firmly, over a certain length, against the wall C. After forming, the bladder is deflated and displaced in order to be repositioned in a new area to expand.

This type of tool is usually designated by the term of "packer".

The tool is connected to the surface through a rod allowing its manipulation, its proper positioning, as well as the control members allowing it to be inflated and deflated. For this purpose, a duct for bringing and discharging the inflation liquid may be integrated to said rod.

According to the invention, provision is made for proceeding with the crimping of tube 1 against the wall C in a limited way, only in certain areas.

At the moment of the making of the tube 1, the periphery thereof is fitted with a set of sheaths 2 in a flexible and elastic material, for example in natural rubber or in polymeric material, capable of providing the seal between the lining and the wall C.

Each sheath 2 is positioned on the tube 1 so that it surrounds an area which has to be expanded; it is attached to the surface of the tube, for example by adhesive bonding.

In FIGS. 2-5, four areas to be expanded are illustrated.

At the beginning of an operation, the tube 1 is centred and immobilized at the head of the well by means of a suitable piece of equipment Z.

Figure 3:
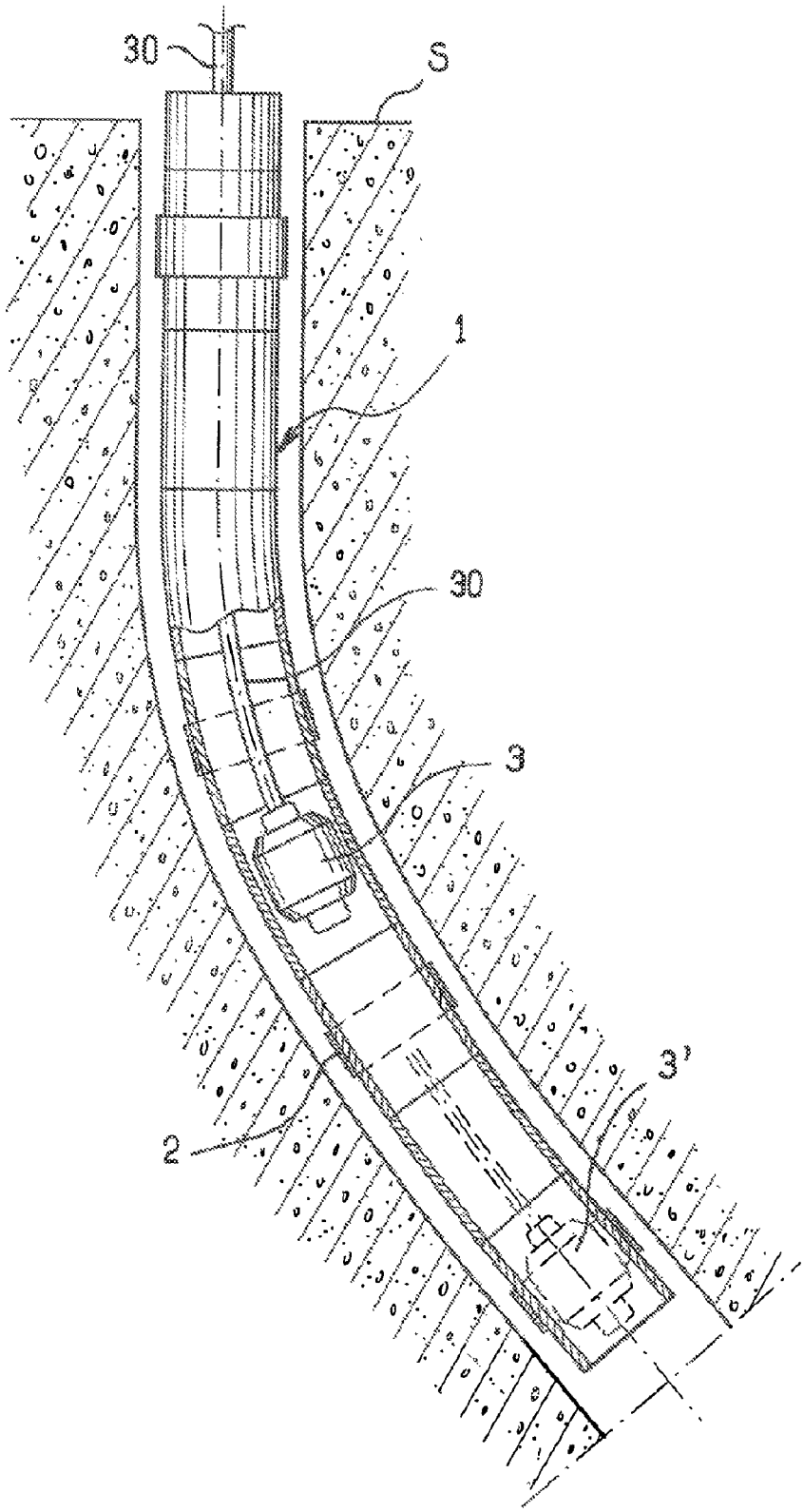

In FIG. 3 the axial introduction into the tube 1 of a dilating tool is illustrated in the form of an inflatable bladder 3, mounted at the end of a manoeuvring and control rod 30 which is actuated from the surface from a non-illustrated control station.

Suitable position sensors associated with a control circuit enable accurate localization and positioning of the bladder 3 in various predetermined locations of the tube 1, in this case, facing each area to be expanded.

The bladder 3 in the deflated condition is first brought into the area to be expanded, the furthest from the surface, in the position 3' illustrated in dashed lines in FIG. 3.

It is then proceeded with its radial expansion, so that it radially dilates the wall portion of the tube against which it will be applied, beyond the elastic limit of the wall of the tube, but below the maximum stress limit. A plastic deformation of this wall is thus observed, which firmly bears against the wall C, with interposition of the flexible sheath 2 which is intended to provide the seal of the connection.

Figure 4:
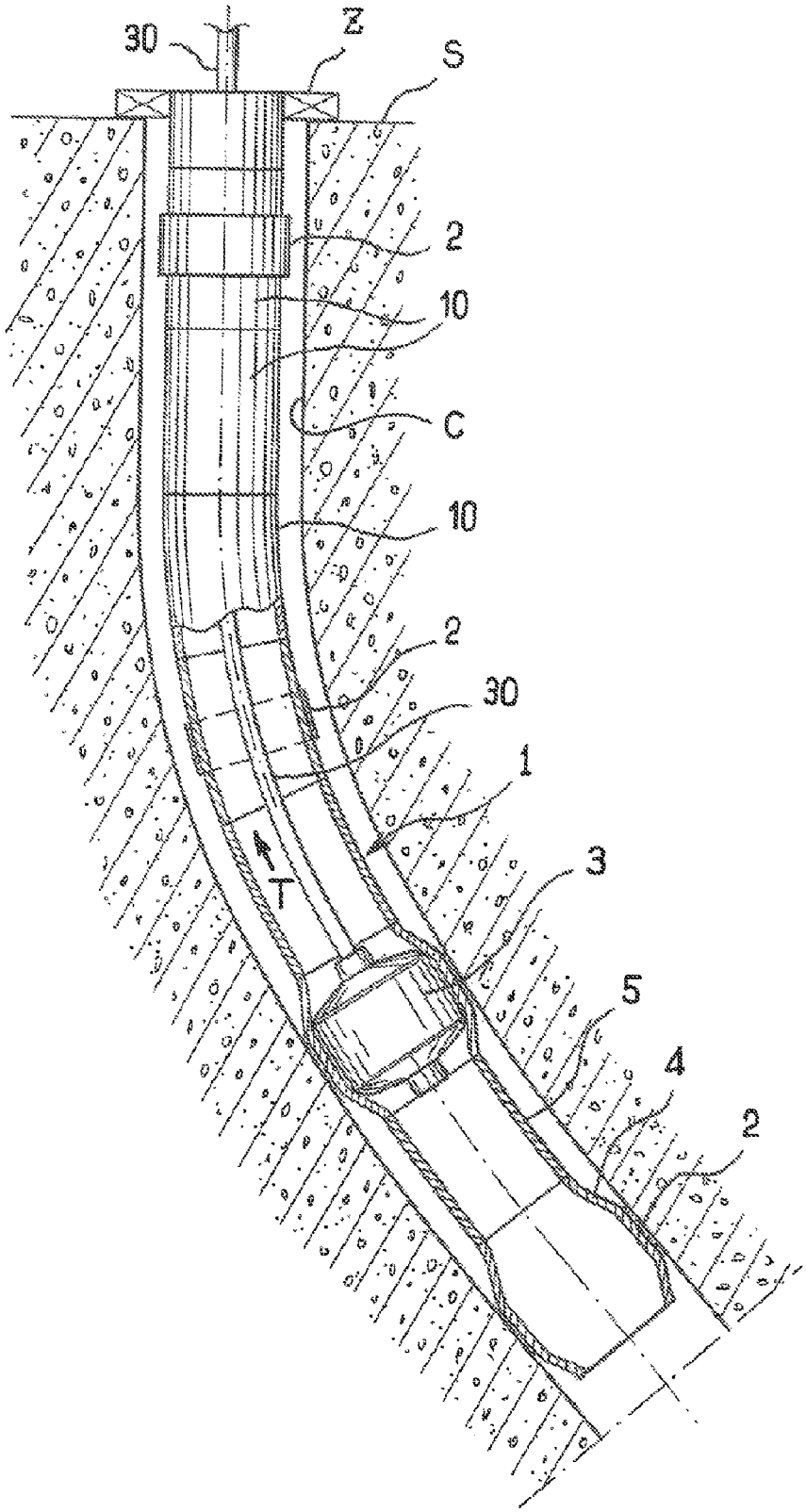

The bladder 3 is then deflated and displaced towards the next area to be expanded, by pulling on the rod 30, and then by inflating/deflating it (see FIG. 4).

This process is repeated as far as the last area to be expanded, the closest to the surface S.

Of course, it is possible to proceed in the opposite direction (from top to bottom) by pushing on the rod 30, from the moment that it is sufficiently rigid.

Figure 5:
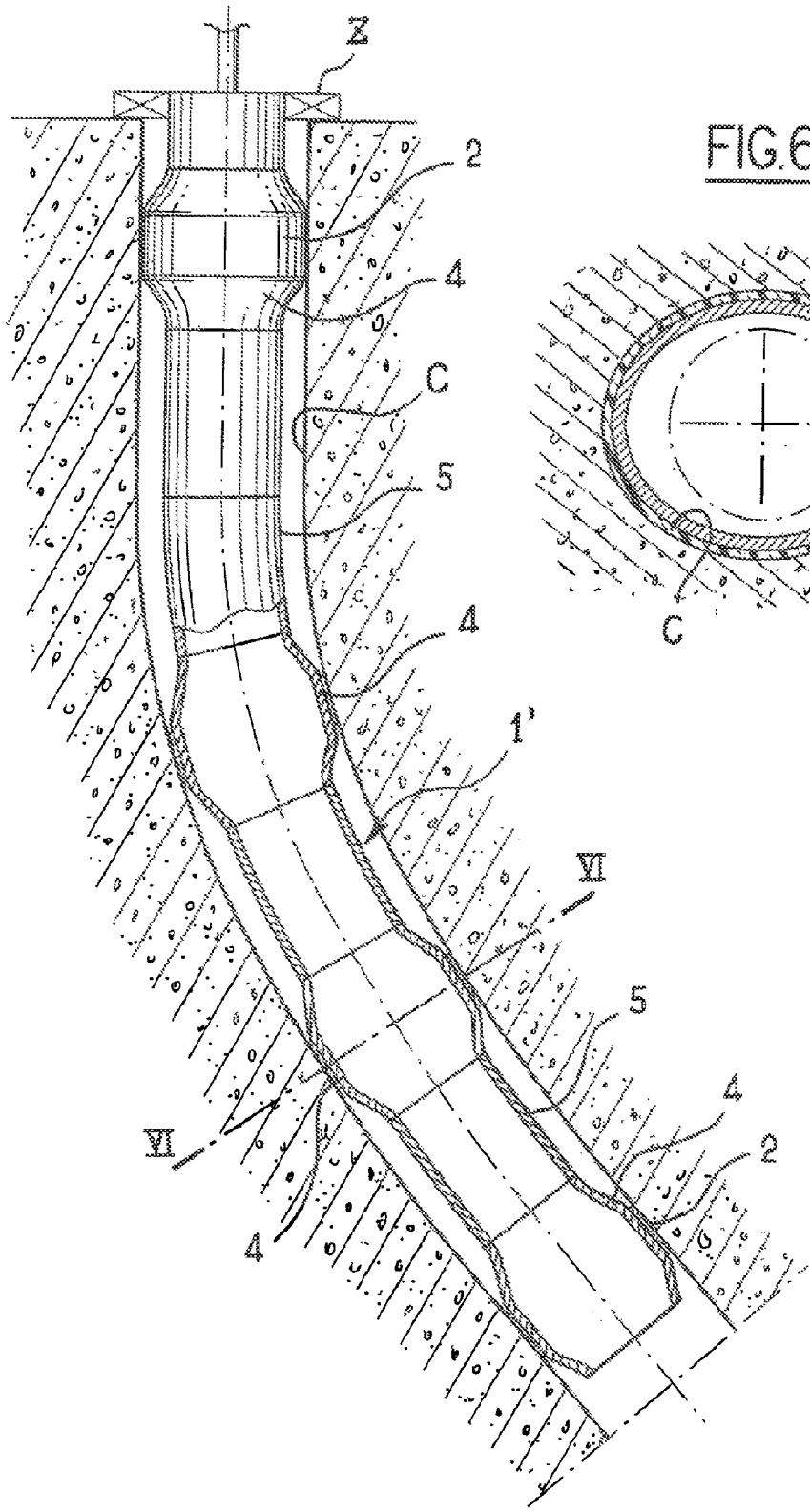

As illustrated in FIG. 5, lining of the well or of the duct is finally obtained by means of a tube 1' having a set of expanded areas 4, which sealably bear against the wall C, and which are spaced apart from each other and separated by non-expanded areas 5 (of unchanged diameter).

It is understood that this lining method is much faster and less costly to apply than a method of the kind described in the documents "Slim-line Re-lining" and EP A 1 157 365 mentioned earlier. The number of successive inflation/deflation operations of the tool required for the operation is much less than that required by integral lining, so that the number of tool changes due to wear is considerably reduced.

The global seal and the mechanical characteristics of the lining remain satisfactory for most applications, in spite of the presence of non-expanded areas. Also, for numerous applications, the presence of non-expanded sections which determine the minimum inner diameter of the liner, is not a nuisance, considering the advantages provided by the method.

Further, the fact that the expansion of the wall of the tube is accomplished in areas with limited length, promotes good contact of the whole periphery of these areas with the wall C, even if the latter is not perfectly circular.

Figure 6:
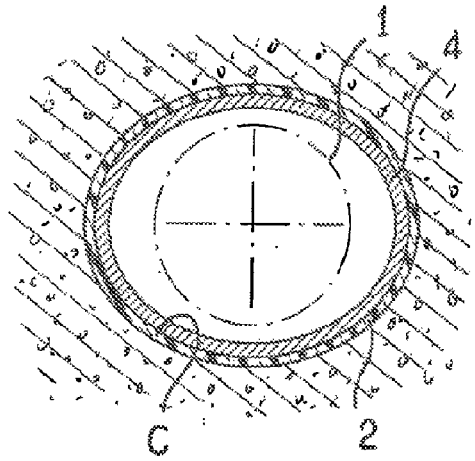
FIG. 6 is a transverse sectional view along the plane VI-VI of FIG. 5.

Thus, the sectional view of FIG. 6 shows an ovalled section of this wall, against which however the expanded area 4 of the initial circular tube 1 is applied intimately, always with interposition of the annular gasket 2. Under the effect of the internal pressure developed by the inflatable bladder, the expanded tube area naturally assumes the same shape as that of the wall against which it is applied, in this case the oval form.

The expanded areas are therefore particularly effective anchoring points of the lining, even if the wall of the well or of the duct has a relatively irregular and non-uniform section.

As an indication, a tool allowing expansion of the tube over a length of 0.75 m may be used for example, and crimping may be performed every 8 meters.

For a length of 912 m, the number of expanded areas is therefore equal to 114 (912:8).

Total length $L_1$ of the expanded areas: 85.50 m (0.75×114).

Total length $L_0$ of the non-expanded areas: 826.50 m (912-85.50).

Ratio: $L_0/L_1=9.66$.

This method may be applied in a very flexible way, depending on the constraints of the application and on the configuration of the ground.

Thus, the distance between two expanded areas is not necessarily constant over the whole length of the tube. It is possible to provide certain expanded areas with a length greater than that of the tool, the expansion in these areas being accomplished by adjacent steps (as provided in the aforementioned documents), but over an area of nevertheless reduced length relatively to the total length of the tube.

Figure 7:
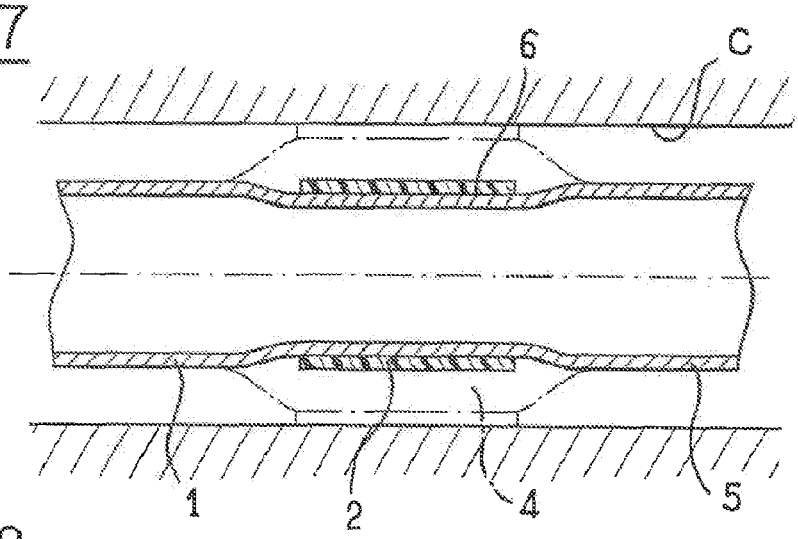
FIG. 7 illustrates an alternative tube with a recessed wall provided with a sealing sheath.

FIG. 7 shows an arrangement in which the tube 1 has wall recesses, i.e. ring-shaped necks 6, which are used for housing the sealing sheath 2.

At these necks, the difference in the radii of the outer wall of the tube is substantially equal to (or slightly larger than) the wall thickness of the flexible sheath 2. Thus, the sheaths do not protrude outwards relatively to the casing of the tube 1, which suppresses risks of catching during its setting into place.

The radial expansion at a neck produces an expanded area 4 (illustrated in dashed lines in FIG. 7) which is similar to an expanded area obtained from a tube without any necking.

Figure 8:
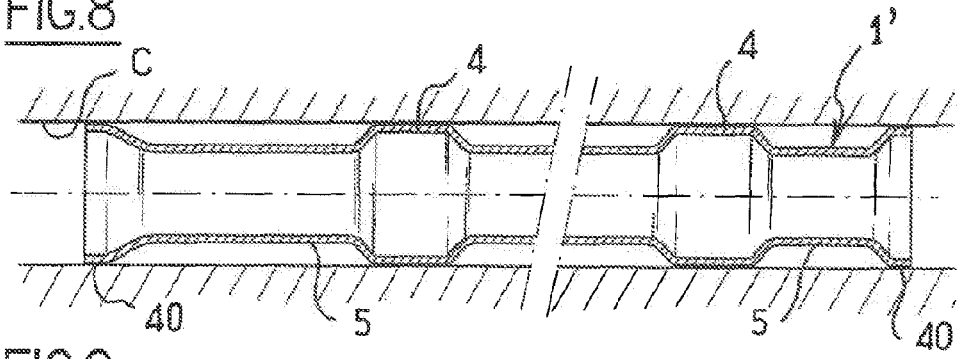
FIG. 8 shows lining with expanded ends.

FIG. 8 illustrates a lining 1' which, in addition to the expanded areas 4 has also expanded end portions, forming mouths 40 which bear against the wall C.

These mouths 40 which may be formed by means of the same inflatable bladder tool as the one used for the areas 4, reduce the risks of catching against the end edges of the tube of equipment likely to be introduced therein or removed therefrom.

They are also advantageously provided with a peripheral sealing sheath.

Figure 9:
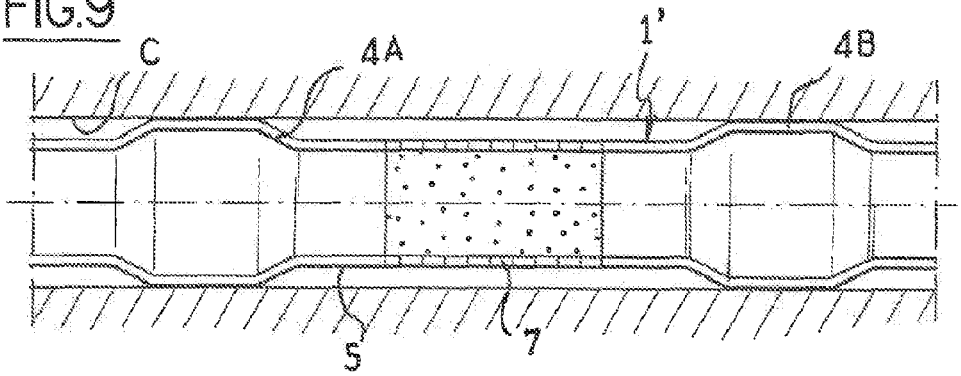
FIG. 9 shows lining including a non-expanded portion with a perforated wall.

FIG. 9 illustrates a lining 1', a non-expanded area 5 of which located between two expanded areas 4A and 4B, includes a perforated or porous wall section 7.

This arrangement may be useful for collecting inside the tube, fluids present in the ground around the area 5, the pervious section 7 acting as a strainer (or drain) and possibly as a filter. Conversely, it may also be useful to inject into the ground, around this area 5, fluids flowing from the tube.

The expansion of the tube might nevertheless just as well be performed in an area with a perforated or porous wall portion.

Figure 10:
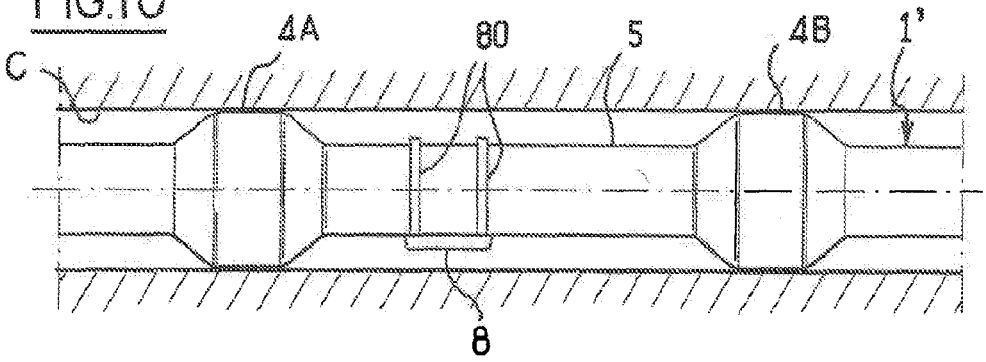
FIG. 10 shows lining, a non-expanded portion of which is provided with a sensor.

FIG. 10 illustrates a lining 1', a non-expanded area 5 of which located between two expanded areas 4A and 4B, is provided with a sensor 8; the latter is attached to the external surface of the tube, for example by means of collars 80. This may be any sensor, for example a pressure or temperature sensor, which may be useful during exploitation of the well or of the duct.

The sensor 8 is found in a closed and protected annular space, outside the tube section 5 and in proximity to the wall C. The placement of such a sensor would not be compatible with continuous expansion of the liner.

The sensor may initially be placed in a recessed portion of the tube, for example in a neck similar to the one illustrated in FIG. 7 for housing a sealing sheath, in order to prevent risks of catching during the introduction and placement of the tube. Partial radial expansion is then accomplished at this neck, in order to retain the annular space required for the sensor.

The expansion areas may either be provided or not with sealing members.

In FIGS. 8-10, the lining has been illustrated without the use of such members.

Of course, such a use is also possible here.

The method of the invention is perfectly compatible with cementation of the liner.

For this, the annular space between the tube and the wall to be treated is cemented and the expansion of the sealing areas is performed before the cement hardens.

By means of this method, the tubing is automatically correctly centred relatively to the wall upon inflating the bladder, and cementation is of good quality.

The present invention is particularly adapted to the lining of wells or ducts, the diameter of which may be comprised, depending on the application, between 75 mm and 250 mm, and the length comprised between 15 m and 1,500 m.

The tube being used for the lining has a wall thickness advantageously comprised between about 2 mm and 8 mm. This thickness, and the ductility of the material which makes it up, are advantageously selected in order to allow a diameter increase in the expanded areas comprised between 5 and 20%, for example of the order of 10%.

The method may optionally be used in several phases.

Certain expansion areas 4 may be made as soon as the initial placement of the cylindrical tube 1 while other areas will be expanded only later, on demand and depending on the needs.

This is particularly of interest for lining productive areas of oil wells or water wells for which the production profile may change over time, certain areas may actually produce undesirable fluids after a certain time.

In order to have the possibility of stopping production of certain areas, it is actually sufficient to alternate facing these areas, tube sections consisting of pervious wall 7 and solid wall portions, with different lengths and adapted to the well, these areas being separated by possible expansion areas.

In a first phase, only one area 4 out of two is expanded, so that the well then produces fluid through all the pervious areas 7.

In a second phase and depending on the needs, it is possible to close one (or more) pervious areas 7 by expanding the area adjacent to the pervious area for which production is no longer intended.

This pervious area is then isolated from the production area, and no longer produces.

Thus, if an area of the well includes a producing area in the portion AB of an ABC area, it is possible to install facing the ABC area, a (non-expanded) liner portion bordered by two expansion areas, one just upstream from A and the other one just downstream from C.

The wall portion of the tube located facing AB is solid; the one located facing BC is pervious.

The fluid is produced facing the solid portion (facing AB) but flows in the annular space between the tube and the wall of the well so as to enter the tube, via the holes of the pervious portion which is facing BC.

When the portion AB of the well produces undesirable fluids, an area just downstream from the point B is expanded in order to isolate the solid portion found facing AB.

The output of the fluid out of the AB portion is thereby blocked.

Figure 11:
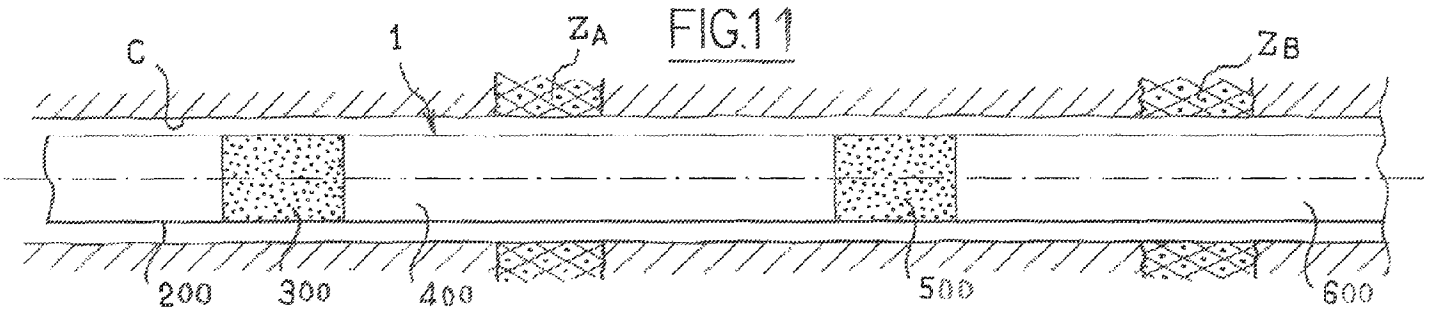
FIGS. 11-13 are axial sectional views of a well which is subject to the control of fluid production, FIGS. 12 and 13 respectively showing the first and second steps of the method.

This technique will be described in more detail hereafter, with reference to FIGS. 11, 12 and 13.

The portion of the well C illustrated on these drawings is illustrated in a horizontal arrangement, and the well head (through which the fluid escapes) is found on the left. Of course the well may be vertical or oblique.

By upstream side will therefore be designated the portion of the well turned towards the right and by downstream side its portion turned towards the left.

The well is a rough bore hole in the ground or a bore hole provided with a well casing (duct).

This well crosses a certain number of fluid producing areas, for example oil layers and/or ground portions saturated with oil, two areas ZA and ZB of which are illustrated.

The area ZA is downstream from the area ZB.

A cylindrical tube 1 of great length, in practice consisting of a certain number of tubes attached end-to-end, was introduced inside this well axially.

As an indication, the well C for example has a length of the order of 1,000 m, and a diameter of the order of 160 mm.

The tube 1 has an external diameter slightly less than that of the well, for example of the order of 140 mm. Its wall thickness for example is of the order of 4 mm.

This is a metal tube, for example in steel, both ductile and capable of resisting to corrosion in the ambient medium.

It comprises impervious portions with a solid wall, 200, 400 and 600, which alternate with pervious portions 300, 500 with a perforated wall.

The location of the pervious portions and the positioning of the tube are selected so that the pervious portions are not facing a production area.

Figure 12:
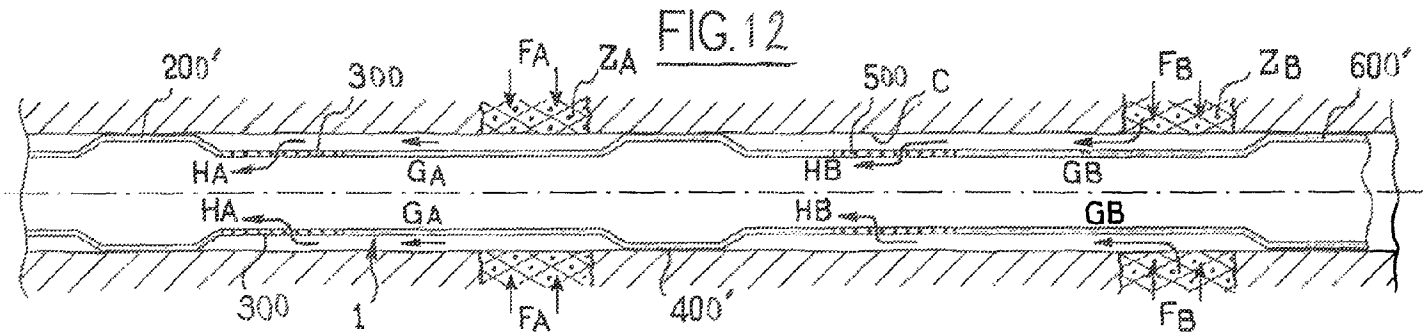

In a first phase, illustrated in FIG. 12, the radial and partial expansion of certain portions of the tube 1 and more specifically of certain of its impervious portions 200, 400, 600 is caused.

Thus, with reference to FIG. 2, it is observed that portions 200' located downstream from the area ZA, 400' located between the areas ZA and ZB and 600' located upstream from the area ZB have been expanded downstream to upstream.

The expanded portions 200' and 400' are found just downstream from a pervious portion 300, respectively 500.

The expanded portions 400' and 600' are found just upstream from an area ZA and respectively ZB.

Facing these areas, an impervious and non-expanded tube wall is found.

The tube 1 is maintained centered in the well by its expanded portions which are intimately applied against its wall, forming a lining.

During a normal period of exploitation, each area ZA, ZB produces fluid which opens out directly into the well if its wall is rough-drilled, via adequate orifices pierced in the wall of the duct, if there exists a well casing. This production is symbolized by the arrows FA and FB in FIG. 12.

The fluid escaping from the area ZA is first channelled into the annular space of the non-expanded and impervious portion of the tube 1, flows downstream (as the upstream side is blocked by the portion 400'), as symbolized by the arrows GA, and then penetrates into the tube via the perforations of the pervious portion 300, as symbolized by the arrows HA.

The progression of the fluid produced by the area ZB is similar.

It is displayed in FIG. 12 by the arrows FB, GB and HB.

Both fluids join up and are discharged downstream in order to be collected at the head of the well.

Of course, there may be more than two producing areas along the well.

It is assumed that after a certain period of exploitation, the area ZA produces an undesirable fluid, the collection of which is not desired, sludge for example.

Figure 13:
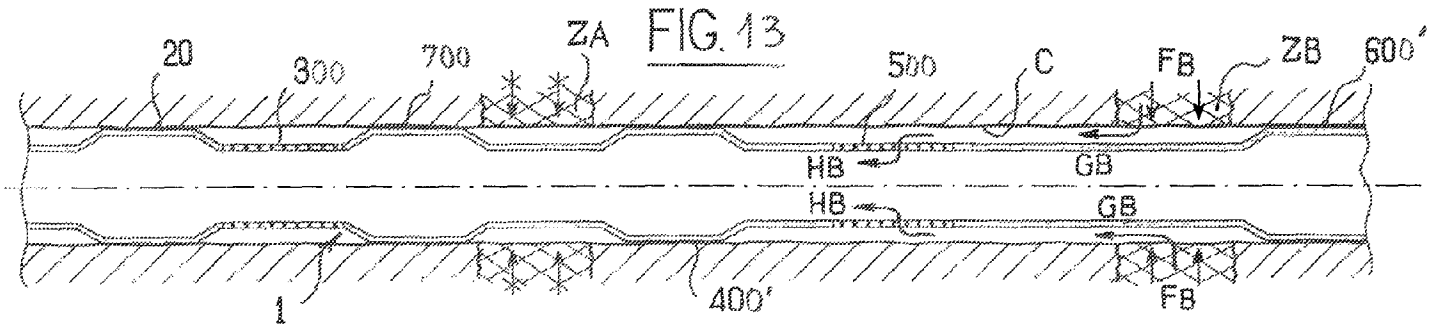

In this case, expansion of the tube portion located just downstream from the area ZA, referenced as 700 in FIG. 13, is caused. The fluid produced by this area ZA is then confined in the annular space outside an impervious portion of the tube, between two dilated areas 400' and 700 which form obstructing plugs. It cannot penetrate into the tube.

The other area ZB continues to produce as previously.

Expansion of the different portions of the tube, both in the first phase and subsequently, when a production area is intended to be isolated, is accomplished in a simple and inexpensive way.

For this it is sufficient to bring into the tube 1, from the well head, an initially deflated inflatable bladder, to position it in the area to be expanded, to inflate it in order to radially deform the tube portion beyond its elastic limit so that it sealably bears against the wall of the well, to deflate the bladder and to remove it.

This method is particularly of interest for lining producing areas of oil wells or water wells, the production profile of which may change over time.

The invention claimed is:

1. A method for lining a well or a duct having a wall with an inflatable bladder with a flexible and elastic membrane, comprising:

introducing a length of cylindrical tube into the well or the duct to be lined, the tube having sections which are attached end-to-end; and radially expanding areas of the tube with an inflatable bladder so a wall of the tube bears against the wall of the well or the duct;

wherein the inflatable bladder is mounted at the end of a manoeuvring and control rod which is actuated from a control station;

wherein only certain areas of the tube are radially expanded, the number of which areas is at least equal to three, and which areas are spaced apart from each other by non-expanded portions so a total length of the expanded areas is notably smaller than a total length of the non-expanded areas;

at least partially deflating the inflatable bladder; and displacing the at least partially deflated bladder from an expanded zone to a next zone to be expanded by pulling or pushing the manoeuvring and control rod;

wherein the tube is provided with at least one sensor placed against the external surface of the tube inside a wall recess which is intended to be only partly expanded.

2. The method according to claim 1, wherein the total length of the expanded areas is at least five times smaller than the total length of the non-expanded areas.

3. The method according to claim 1, further comprising:

fitting flexible elastic sheaths to the outside of the tube at the tube areas to be radially expanded, wherein the sheaths provide a seal between the expanded areas of the tube and the wall of the well or the duct after the tube is radially expanded.

4. The method according to claim 3, wherein the wall of the tube comprises recesses, the flexible sheaths being housed in the recesses so as not to protrude on the outside relative to the external surface of the tube.

5. The method according to claim 1, further comprising radially expanding at least one of the ends of the tube in order to form a mouth therein, which mouth is applied against the wall of the well or the duct.

6. The method according to claim 1, wherein at least one wall portion of the tube is perforated or porous and is adapted to act as a strainer or filter.

7. The method according to claim 1, further comprising:

providing the tube with at least one sensor positioned against the external surface of the tube in an area of the tube which is not intended to be expanded, and which area of the tube is between two areas of the tube which are intended to be expanded.

8. The method according to claim 1, wherein the step of radially expanding the tube comprises successive steps, each successive step comprising radially expanding an area of the tube by displacing the inflatable bladder, the method further comprising gradually displacing the inflatable bladder in one direction from one end of the tube to the other end of the tube.

9. The method according to claim 1, further comprising:

injecting liquid cement between the outer surface of the tube and the wall of the well or the duct after the tube is introduced into the well or the duct, partially expanding the tube while the cement is still liquid or semi-liquid, permitting the cement to set.

10. A method for controlling the production of fluid inside a well, allowing the plugging of a producing area during exploitation, comprising:

axially introducing a length of cylindrical tube, the diameter of which tube is slightly smaller than the diameter of the well, the tube comprising pervious portions having a wall which is pervious to the fluid being produced and impervious portions having a wall which is substantially impervious to the fluid being produced, wherein the pervious portions are alternatively positioned between the impervious portions;

radially expanding certain of the impervious portions so the wall of each expanded impervious portion bears against the wall of the well in such a way that two expanded portions of the tube are located on either side of an area to be controlled and the two expanded portions are connected to each other through a tube section comprising a pervious portion and an impervious portion, the impervious portion being adjacent to the area to be controlled and extending beyond the area to be controlled in the direction of the pervious portion; and subsequently, when it is desired to prevent the area to be controlled from producing fluid, radially expanding the impervious portion of said tube section beyond the area to be controlled on the side of the pervious portion.

11. The method according to claim 10, wherein the total length of the expanded areas is at least five times smaller than the total length of the non-expanded areas.

12. The method according to claim 10, further comprising:

fitting flexible elastic sheaths to the outside of the tube at the tube areas to be radially expanded, wherein the sheaths provide a seal between the expanded areas of the tube and the wall of the well or the duct after the tube is radially expanded.

13. The method according to claim 12, wherein the wall of the tube comprises recesses, the flexible sheaths being housed in the recesses so as not to protrude on the outside relative to the external surface of the tube.

14. The method according to claim 10, further comprising radially expanding at least one of the ends of the tube in order to form a mouth therein, which mouth is applied against the wall of the well or the duct.

15. The method according to claim 10, wherein at least one wall portion of the tube is perforated or porous and is adapted to act as a strainer or filter.

16. The method according to claim 10, further comprising:

providing the tube with at least one sensor positioned against the external surface of the tube in an area of the tube which is not intended to be expanded, and which area of the tube is between two areas of the tube which are intended to be expanded.

17. The method according to claim 10, wherein the step of radially expanding the tube comprises successive steps, each successive step comprising radially expanding an area of the tube by displacing the inflatable bladder, the method further comprising gradually displacing the inflatable bladder in one direction from one end of the tube to the other end of the tube.

18. The method according to claim 10, further comprising:

injecting liquid cement between the outer surface of the tube and the wall of the well or the duct after the tube is introduced into the well or the duct, partially expanding the tube while the cement is still liquid or semi-liquid, permitting the cement to set.

19. A method for lining a well or a duct having a wall with an inflatable bladder, comprising:

introducing a length of cylindrical tube into the well or the duct to be lined, the tube having sections which are attached end-to-end;

radially expanding areas of the tube with an inflatable bladder so a wall of the tube bears against the wall of the well or the duct;

wherein only certain areas of the tube are radially expanded, the number of which areas is at least equal to three, and which areas are spaced apart from each other by non-expanded portions so a total length of the expanded areas is notably smaller than a total length of the non-expanded areas;

wherein the tube is provided with at least one sensor placed against the external surface of the tube inside a wall recess which is intended to be only partly expanded.

20. The method according to claim 19, wherein the total length of the expanded areas is at least five times smaller than the total length of the non-expanded areas.

21. The method according to claim 19, further comprising:

fitting flexible elastic sheaths to the outside of the tube at the tube areas to be radially expanded, wherein the sheaths provide a seal between the expanded areas of the tube and the wall of the well or the duct after the tube is radially expanded.

22. The method according to claim 21, wherein the wall of the tube comprises recesses, the flexible sheaths being housed in the recesses so as not to protrude on the outside relative to the external surface of the tube.

23. The method according to claim 19, further comprising radially expanding at least one of the ends of the tube in order to form a mouth therein, which mouth is applied against the wall of the well or the duct.

24. The method according to claim 19, wherein at least one wall portion of the tube is perforated or porous and is adapted to act as a strainer or filter.

25. The method according to claim 19, further comprising:

providing the tube with at least one sensor positioned against the external surface of the tube in an area of the tube which is not intended to be expanded, and which area of the tube is between two areas of the tube which are intended to be expanded.

26. The method according to claim 19, wherein the step of radially expanding the tube comprises successive steps, each successive step comprising radially expanding an area of the tube by displacing the inflatable bladder, the method further comprising gradually displacing the inflatable bladder in one direction from one end of the tube to the other end of the tube.

27. The method according to claim 19, further comprising:

injecting liquid cement between the outer surface of the tube and the wall of the well or the duct after the tube is introduced into the well or the duct, partially expanding the tube while the cement is still liquid or semi-liquid, permitting the cement to set.

* * * * *